US011097920B2

(12) United States Patent
Kunieda et al.

(10) Patent No.: US 11,097,920 B2
(45) Date of Patent: Aug. 24, 2021

(54) SHEET FOLDING APPARATUS AND IMAGE FORMING SYSTEM INCORPORATING SAME

(71) Applicants: Akira Kunieda, Tokyo (JP); Tomohiro Furuhashi, Kanagawa (JP); Michitaka Suzuki, Kanagawa (JP); Wataru Takahashi, Tokyo (JP); Fumiharu Yoneyama, Kanagawa (JP); Kazuyoshi Matsuo, Kanagawa (JP); Makoto Hidaka, Tokyo (JP); Takahiro Watanabe, Kanagawa (JP); Takuya Morinaga, Tokyo (JP); Yohsuke Haraguchi, Kanagawa (JP)

(72) Inventors: Akira Kunieda, Tokyo (JP); Tomohiro Furuhashi, Kanagawa (JP); Michitaka Suzuki, Kanagawa (JP); Wataru Takahashi, Tokyo (JP); Fumiharu Yoneyama, Kanagawa (JP); Kazuyoshi Matsuo, Kanagawa (JP); Makoto Hidaka, Tokyo (JP); Takahiro Watanabe, Kanagawa (JP); Takuya Morinaga, Tokyo (JP); Yohsuke Haraguchi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/881,440

(22) Filed: May 22, 2020

(65) Prior Publication Data

US 2020/0385231 A1 Dec. 10, 2020

(30) Foreign Application Priority Data

Jun. 7, 2019 (JP) ..... JP2019-107071

(51) Int. Cl.
*B65H 45/04* (2006.01)
*B65H 45/14* (2006.01)
(Continued)

(52) U.S. Cl.
CPC ..... *B65H 45/147* (2013.01); *B65H 29/125* (2013.01); *B65H 45/04* (2013.01);
(Continued)

(58) Field of Classification Search
None
See application file for complete search history.

(56) References Cited

U.S. PATENT DOCUMENTS 9,159,002 B2 * 10/2015 Takata ..... B65H 29/125
10,071,874 B2 * 9/2018 Taki ..... B65H 37/04
(Continued)

FOREIGN PATENT DOCUMENTS

JP 5-229727 9/1993
JP 2009-173442 8/2009
(Continued)

OTHER PUBLICATIONS

U.S. Appl. No. 16/715,608, filed Dec. 16, 2019, Michitaka Suzuki, et al.

*Primary Examiner* — Leslie A Nicholoson, III
(74) *Attorney, Agent, or Firm* — Harness, Dickey & Pierce, P.L.C.

(57) ABSTRACT

A sheet folding apparatus includes a conveyance member to convey a sheet from an ejection member at a first speed lower than a conveyance speed by the ejection member or a second speed substantially same as or higher than the conveyance speed; a registration member; a pair of first and second rollers to rotate in forward and reverse directions; a plurality of folding rollers downstream from the second roller, to rotate in forward and reverse directions to fold the
(Continued)

sheet; and circuitry to determine whether the sheet is equal to or smaller than a reference length from an exit position from the ejection member to a folding start position downstream from the pair of the first and second rollers. The circuitry performs first-speed folding when the sheet is equal to or smaller than the reference length and performs second-speed folding when the sheet is longer than the reference length.

9 Claims, 9 Drawing Sheets

(51) Int. Cl.
*B65H 29/12* (2006.01)
*B65H 45/20* (2006.01)

(52) U.S. Cl.
CPC ... *B65H 45/20* (2013.01); *B65H 2701/13212* (2013.01); *B65H 2801/03* (2013.01); *B65H 2801/27* (2013.01)

(56) References Cited

U.S. PATENT DOCUMENTS

| | | | | |
|---|---|---|---|---|
| 10,105,968 | B2 * | 10/2018 | Iwata | B41J 11/0045 |
| 10,214,377 | B2 * | 2/2019 | Dobashi | B65H 29/20 |
| 10,710,834 | B2 * | 7/2020 | Hidaka | B65H 29/125 |
| 10,747,157 | B2 * | 8/2020 | Zuo | B41J 13/0009 |
| 2009/0065998 | A1 * | 3/2009 | Iguchi | G03G 15/6544 270/1.01 |
| 2014/0141956 | A1 | 5/2014 | Suzuki et al. | |
| 2014/0153993 | A1 * | 6/2014 | Ono | B65H 7/06 400/621 |
| 2014/0171283 | A1 | 6/2014 | Furuhashi et al. | |
| 2019/0276263 | A1 | 9/2019 | Hidaka et al. | |
| 2019/0284008 | A1 | 9/2019 | Sakano et al. | |
| 2019/0284009 | A1 | 9/2019 | Suzuki et al. | |
| 2019/0284010 | A1 | 9/2019 | Asami et al. | |
| 2019/0284011 | A1 | 9/2019 | Furuhashi et al. | |
| 2019/0367317 | A1 | 12/2019 | Haraguchi et al. | |
| 2020/0255252 | A1 * | 8/2020 | Seki | B65H 29/14 |

FOREIGN PATENT DOCUMENTS

| | | |
|---|---|---|
| JP | 2014-101164 | 6/2014 |
| JP | 2014-118241 | 6/2014 |

* cited by examiner

SHEET FOLDING APPARATUS AND IMAGE FORMING SYSTEM INCORPORATING SAME

CROSS-REFERENCE TO RELATED APPLICATION

This patent application is based on and claims priority pursuant to 35 U.S.C. § 119(a) to Japanese Patent Application No. 2019-107071, filed on Jun. 7, 2019, in the Japan Patent Office, the entire disclosure of which is hereby incorporated by reference herein.

BACKGROUND

Technical Field

This disclosure relates to a sheet folding apparatus and an image forming system incorporating the sheet folding apparatus.

Related Art

There are sheet folding apparatuses that are disposed on the sheet ejection side of an image forming apparatus. Such a sheet folding apparatus receives sheets on which images has been formed, performs various folding processes, such as half fold and Z-fold, on the sheets, and then ejects or forwards the sheets to a sheet post-processing apparatus disposed on the downstream side.

In this type of sheet folding apparatus, there is a sheet folding apparatus that includes a plurality of rollers and is capable of a plurality of folding processes, such as half fold, Z-fold, and double parallel fold, while conveying the sheet between the plurality of rollers in different manners.

SUMMARY

An embodiment of this disclosure provides a sheet folding apparatus to fold a sheet ejected from an upstream apparatus to which the sheet folding apparatus is coupled. The sheet folding apparatus includes a conveyance member configured to receive the sheet ejected from an ejection member of the upstream apparatus and convey the sheet in a sheet conveyance direction at either a first speed lower than a conveyance speed of the sheet by the ejection member or a second speed substantially the same as or higher than the conveyance speed by the ejection member, a registration member, a pair of a first roller and a second roller, and a plurality of folding rollers disposed downstream from the second roller in the sheet conveyance direction. The registration member nips the sheet from the conveyance member and conveys the sheet downstream in the sheet conveyance direction, at a timing, at either the first speed or the second speed. The pair of the first roller and the second roller is configured to nip and convey the sheet from the registration member at either the first speed or the second speed, and rotates in forward and reverse directions. The plurality of folding rollers rotates in forward and reverse directions to fold the sheet. The sheet folding apparatus further includes control circuitry configured to determine whether a length of the sheet in the sheet conveyance direction is equal to or smaller than a reference length. The reference length is from an exit position from the ejection member to a folding operation start position downstream from the pair of the first roller and the second roller in the sheet conveyance direction. In response to a determination that the length of the sheet is equal to or smaller than the reference length, perform first-speed folding in which the conveyance member, the registration member, and the pair of the first roller and the second roller rotate at the first speed to fold the sheet. In response to a determination that the length of the sheet is longer than the reference length, perform second-speed folding in which the conveyance member, the registration member, and the pair of the first roller and the second roller rotate at the second speed to fold the sheet.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
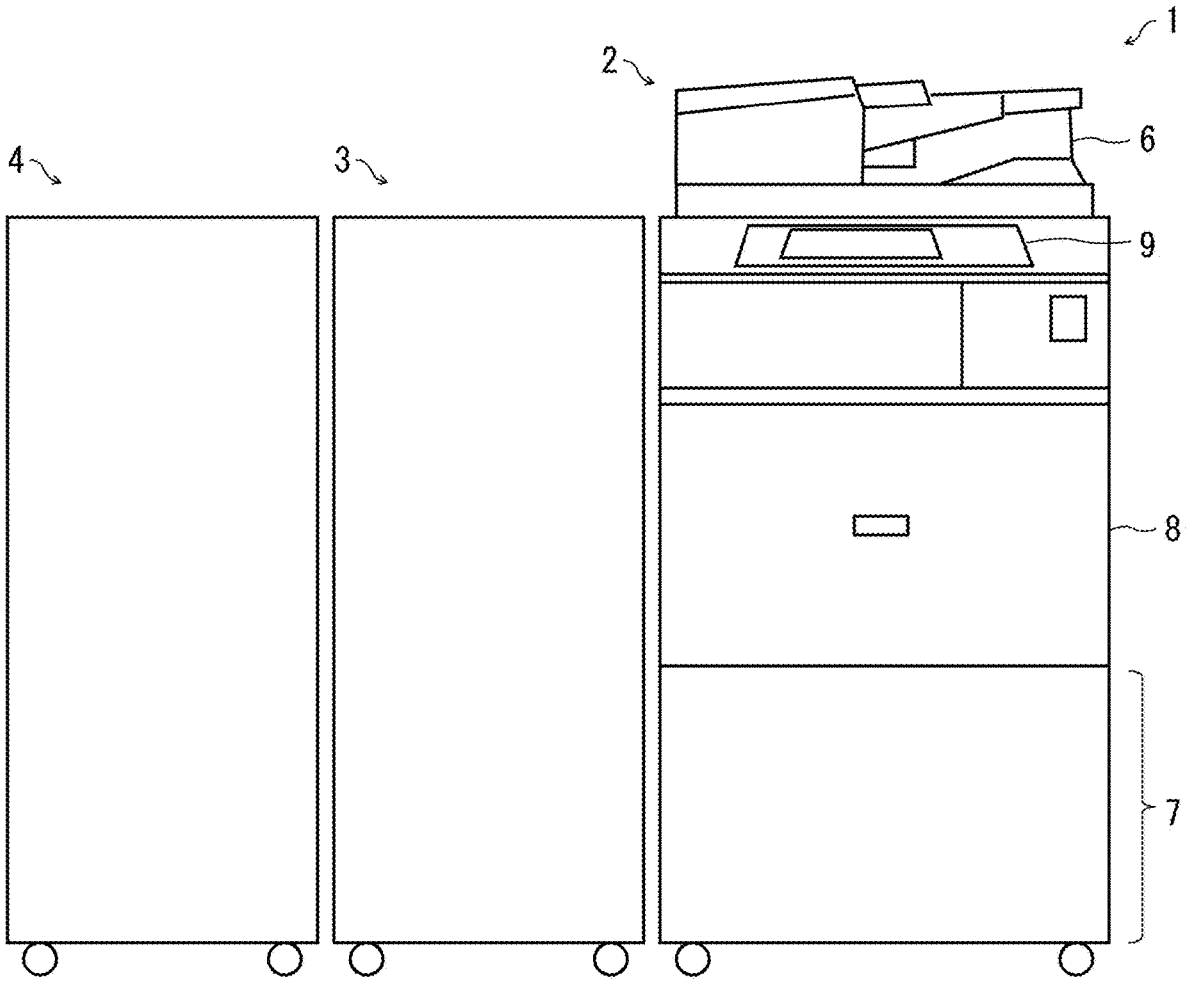
FIG. 1 is a schematic view illustrating a configuration of an image forming system according to one embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected, and it is to be understood that each specific element includes all technical equivalents that have the same function, operate in a similar manner, and achieve a similar result.

Referring now to the drawings, wherein like reference numerals designate identical or corresponding parts throughout the several views thereof, embodiments of this disclosure are described. As used herein, the singular forms "a," "an," and "the" are intended to include the plural forms as well, unless the context clearly indicates otherwise.

FIG. 1 illustrates an image forming system including a sheet folding system according to an embodiment of the present disclosure. In FIG. 1, an image forming system 1 mainly includes an image forming apparatus 2, which is a full-color copier, a sheet folding apparatus 3, and a sheet post-processing apparatus 4.

The image forming apparatus 2 is an upstream apparatus coupled to an upstream side of the sheet folding apparatus 3 in the direction of conveyance of transfer sheets (sheet conveyance direction). The image forming apparatus 2 includes a document reading device 6, a sheet feeder 7, an image forming unit 8, a control panel 9, and the like. According to setting set on the control panel 9 and an image of a document read by the document reading device 6, the image forming unit 8 forms an image on a transfer sheet (a sheet), serving as a recording medium, stored in the sheet feeder 7. The transfer sheet on which an image has been formed in the image forming apparatus 2 is sent, via an ejection roller pair 5 (an ejection member) described later, to the sheet folding apparatus 3 coupled to the downstream side of the image forming apparatus 2 in the sheet conveyance direction. The sheet feeder 7 can accommodate a plurality of sheet trays that store a plurality of transfer sheets in the same manner as a typical image forming apparatus. Additionally, instead of a sheet tray, a roll of a long transfer sheet can be mounted in the sheet feeder 7. When the transfer sheet roll is mounted, the portion of the transfer sheet roll on which an image has been formed is cut to a desired length by a cutter of the image forming unit 8. The desired length is set on the control panel 9 by a user.

The sheet folding apparatus 3 and the sheet post-processing apparatus 4 perform folding process on the transfer sheet sent from the image forming apparatus 2 and then eject the transfer sheet. The sheet post-processing apparatus 4 is a downstream apparatus coupled to the downstream side of the sheet folding apparatus 3 in the sheet conveyance direction and performs post-processing such as sorting or stapling on the transfer sheet that has passed through the sheet folding apparatus 3.

Figure 2:
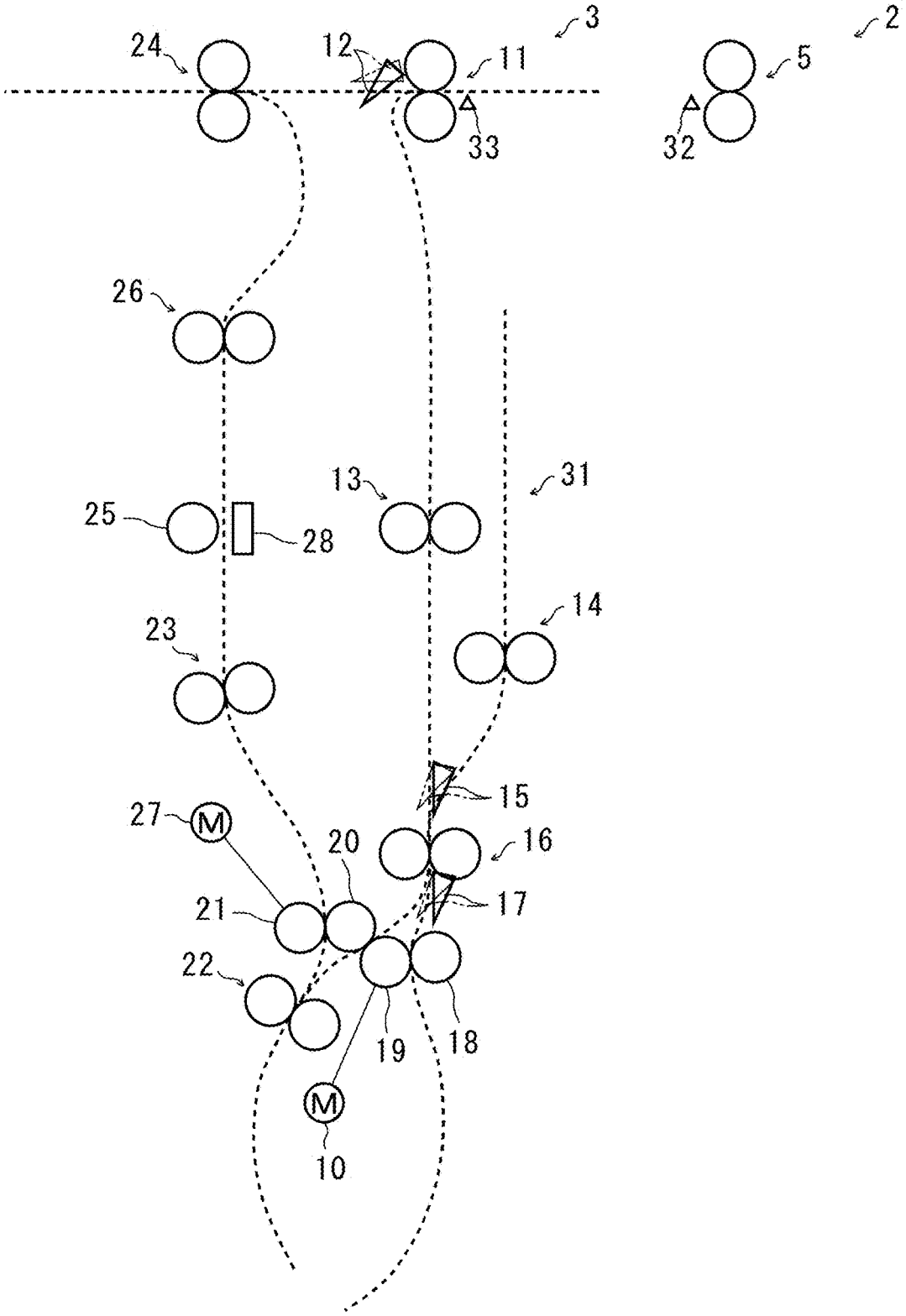
FIG. 2 is a schematic view illustrating a configuration of a sheet folding apparatus according to one embodiment of the present disclosure.

FIG. 2 illustrates a configuration of the sheet folding apparatus 3. The sheet folding apparatus 3 includes an entry roller pair 11, a first bifurcating claw 12, a conveyance roller pair 13, a drawing-in roller pair 14, a second bifurcating claw 15, a registration roller pair 16, a third bifurcating claw 17, and first, second, third, and fourth folding rollers, 18, 19, 20, and 21 serving as folding devices. The sheet post-processing apparatus 4 further includes a drawing-in roller pair 22, a conveyance roller pair 23, a fold-enforcing roller 25 as a fold-enforcing device, a conveyance roller pair 26, and an ejection roller pair 24.

The ejection roller pair 5 that nips and conveys the transfer sheet is disposed at an ejection section of the image forming apparatus 2. The entry roller pair 11 (a conveyance member) is disposed at the extreme upstream position in the sheet folding apparatus 3 in the sheet conveyance direction. The entry roller pair 11 receives the transfer sheet from the ejection roller pair 5 and conveys the transfer sheet to the downstream side. The first bifurcating claw 12 that selectively occupies a first position and a second position is disposed downstream from the entry roller pair 11 in the sheet conveyance direction. When the first bifurcating claw 12 occupies the first position indicated by the solid line in FIG. 2, the transfer sheet conveyed by the entry roller pair 11 is guided downward in FIG. 2 and forwarded to the conveyance roller pair 13. When the first bifurcating claw 12 occupies the second position indicated by a two-dot chain line in FIG. 2, the transfer sheet conveyed by the entry roller pair 11 is guided leftward in FIG. 2 and forwarded to the ejection roller pair 24.

The conveyance roller pair 13 conveys the received transfer sheet downward in FIG. 2. Disposed downstream from the conveyance roller pair 13 in the sheet conveyance direction is the second bifurcating claw 15 that selectively occupies a first position and a second position. When the second bifurcating claw 15 occupies the first position indicated by the solid line in FIG. 2, the transfer sheet conveyed by the conveyance roller pair 13 is guided downward in FIG. 2 to the registration roller pair 16 capable of forward and reverse rotation. The transfer sheets are overlaid one on another as follows. When the second bifurcating claw 15 occupies the second position indicated by the two-dot chain line in FIG. 2, the sheet conveyance passage to the drawing-in roller pair 14 is opened. As the registration roller pair 16 nipping the transfer sheet rotates in reverse to the direction for normal conveyance, the transfer sheet is received by the drawing-in roller pair 14 and sent to a drawing-in passage 31. At the same time as the conveyance roller pair 13 delivers the next transfer sheet to the registration roller pair 16, the drawing-in roller pair 14 delivers the transfer sheet in the drawing-in passage 31 to the registration roller pair 16, and the transfer sheets are overlaid one on another at the registration roller pair 16.

While the registration roller pair 16 stays stationary, the leading end of the transfer sheet conveyed is brought into the nip between the registration roller pair 16 pressing against each other. Then, at a predetermined timing, the registration roller pair 16 rotates in the forward direction, which is the direction of rotation during normal conveyance, thereby conveying the transfer sheet to the downstream side.

The third bifurcating claw 17 that selectively occupies a first position and a second position is disposed downstream from the registration roller pair 16 in the sheet conveyance direction. The first folding roller 18 (a first roller) is below the third bifurcating claw 17, and the second folding roller 19 (a second roller) is on the left side thereof in the drawing. The first folding roller 18 is in contact with the second folding roller 19 and rotates with the rotation of the second folding roller 19. The second folding roller 19 is rotated by a drive motor 10 and capable of normal rotation and reverse rotation. The drive motor 10 is rotatable in the forward and reverse directions and capable of changing the speed at least in two stages of a low speed and a high speed.

In FIG. 2, the third folding roller 20 is disposed above and on the left of the second folding roller 19 and in contact with the second folding roller 19. The fourth folding roller 21 is on the left of the third folding roller 20 and in contact with the third folding roller 20. The third folding roller 20 (one of a plurality of folding rollers) rotates with the rotation of the second folding roller 19 or the fourth folding roller 21. The fourth folding roller 21 (another one of the plurality of folding rollers) is rotated by a drive motor 27, similar to the third folding roller 20. The drive motor 27 is rotatable in the forward and reverse directions and capable of changing the speed at least in two stages of a low speed and a high speed. The fourth folding roller 21 includes a built-in one-way clutch. Although the rotational force from the fourth folding roller 21 is transmitted to the third folding roller 20, the rotational force from the third folding roller 20 is not transmitted to the fourth folding roller 21.

When the third bifurcating claw 17 occupies the first position indicated by the solid line in FIG. 2, the transfer sheet sent from the registration roller pair 16 is nipped between the first folding roller 18 and the second folding roller 19 and is conveyed in the direction directly below in FIG. 2.

When the third bifurcating claw 17 occupies the second position indicated by the chain double-dashed line in FIG. 2, the transfer sheet sent from the registration roller pair 16 is nipped between the second folding roller 19 and the third folding roller 20. The transfer sheet is conveyed in the direction lower left in FIG. 2 and nipped by the drawing-in roller pair 22.

When the fourth folding roller 21 rotates in reverse with the transfer sheet nipped by the drawing-in roller pair 22, the transfer sheet is conveyed upward in FIG. 2. The conveyance roller pair 23 further conveys the transfer sheet upward. The fold-enforcing roller 25, the description thereof is deferred, is disposed downstream from the conveyance roller pair 23 in the sheet conveyance direction.

The conveyance roller pair 26 is disposed downstream from the fold-enforcing roller 25 in the sheet conveyance direction. Further, the ejection roller pair 24 is disposed on the downstream side thereof. After the fold thereof is enforced by the fold-enforcing roller 25, the transfer sheet is conveyed, via the conveyance roller pair 26 and the ejection roller pair 24, to the sheet post-processing apparatus 4 disposed downstream from the sheet folding apparatus 3 in the sheet conveyance direction.

Figure 3:
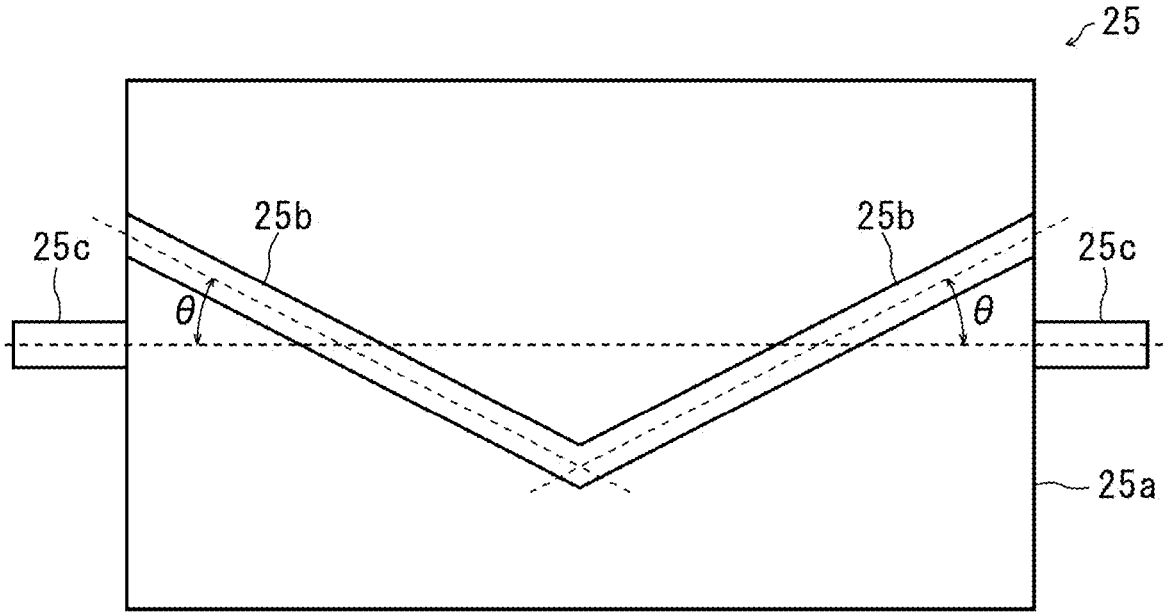
FIG. 3 is a schematic view of a fold-enforcing roller used in one embodiment of the present disclosure.

As illustrated in FIG. 3, the fold-enforcing roller 25 includes a ridge 25*b* (a projecting line) as a protrusion on the peripheral surface of a roller body 25*a*. Thus, the roller body 25*a* is a support to support the ridge 25*b*. The ridge 25*b* is at an angle θ with a support shaft 22*c* and is in line-symmetry in the width direction of the roller body 25*a* with respect to a center in the width direction. Use of the fold-enforcing roller 25 having such a configuration can increase the efficiency of fold enforcing since portions of the ridge 25*b* can simultaneously contact the fold on the transfer sheet at two locations.

Figure 4:
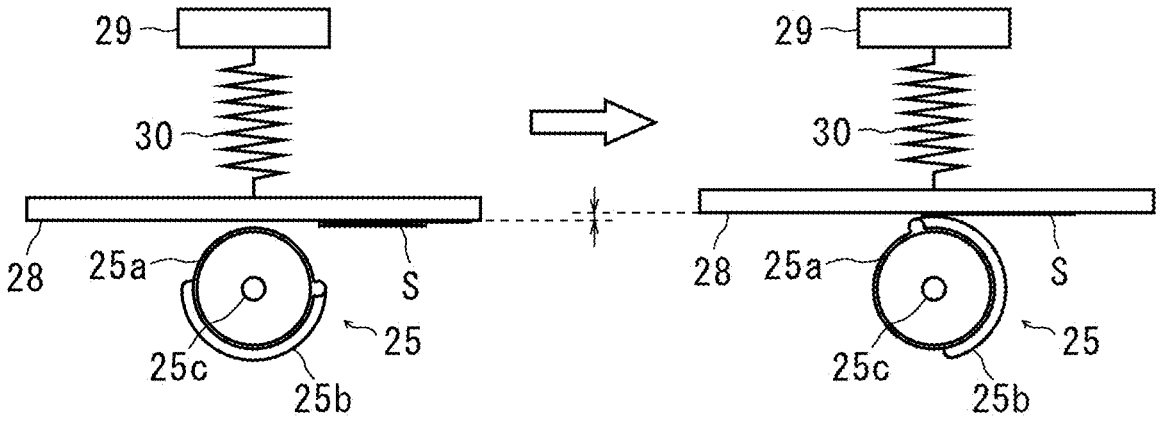
FIG. 4 is a schematic view of a sheet support plate used in one embodiment of the present disclosure.

As illustrated in FIG. 4, a sheet support plate 28 that supports the conveyance of a transfer sheet S is disposed opposite the fold-enforcing roller 25 via the sheet conveyance passage. The sheet support plate 28 is provided with a compression spring 30 having one end fixed to a stationary member 29 fixed to the body of the sheet folding apparatus 3. The other end of the compression spring 30 is attached to the sheet support plate 28 to urge the sheet support plate 28 toward the fold-enforcing roller 25. With this configuration, the transfer sheet S is conveyed between the sheet support plate 28 and the roller body 25*a* illustrated in FIG. 4. After the transfer sheet S is stopped with the fold of the transfer sheet S set at a predetermined position, the fold-enforcing roller 25 is rotated, and the ridge 25*b* contacts the sheet support plate 28 via the transfer sheet S. With the contact, the sheet support plate 28 is displaced. The urging force of the compression spring 30 presses the sheet support plate 28 against the ridge 25*b*. Then, the fold on the transfer sheet S is enhanced.

Next, a description is given of an operation for forming a Z-fold on the transfer sheet using the sheet folding apparatus 3, with reference to FIGS. 5A to 5D.

First, the entry roller pair 11 introduces the transfer sheet S bearing an image formed in the image forming apparatus 2 into the sheet folding apparatus 3. Then, the first bifurcating claw 12 at the first position guides the transfer sheet S to the conveyance roller pair 13. The transfer sheet S conveyed by the conveyance roller pair 13 is guided by the second bifurcating claw 15 occupying the first position and is forwarded to the registration roller pair 16.

The transfer sheet S that has reached the registration roller pair 16 is guided by the third bifurcating claw 17 located at the first position and is conveyed downward while being nipped between the second folding roller 19 rotating in the forward direction and the first folding roller 18 rotating therewith. When the transfer sheet S is conveyed downward by a predetermined amount from the position nipped by the first and second folding rollers 18 and 19, the second folding roller 19 is rotated in the reverse direction (counterclockwise in the drawing), to slacken the transfer sheet S between the registration roller pair 16 and the first and second folding rollers 18 and 19. Then, the second folding roller 19 rotates in the reverse direction and guides, with the registration roller pair 16, the slack of the transfer sheet S between the second and third folding rollers 19 and 20. The transfer sheet S is nipped by the second folding roller 19 and the third folding roller 20. Thus, a first folding process is performed as illustrated in FIG. 5A.

Figure 5A:
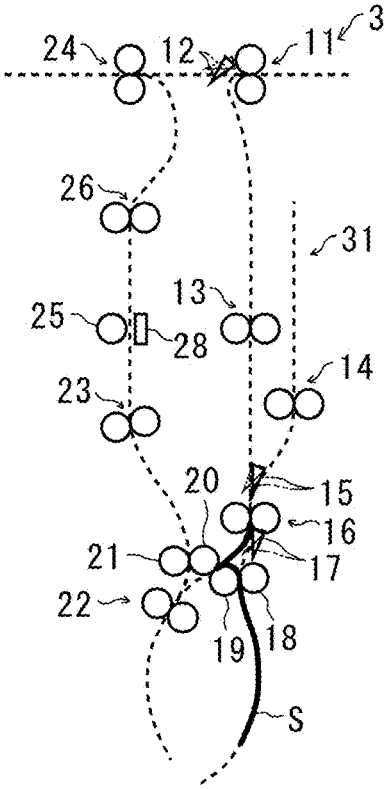
FIGS. 5A to 5D are schematic views illustrating a Z-fold operation on a transfer sheet by the sheet folding apparatus illustrated in FIG. 2.

After the first folding process is performed thereon, the transfer sheet S is nipped between the second folding roller 19 and the third folding roller 20 and conveyed to the lower left in FIG. 5A. Then, the fold on the transfer sheet S is nipped by the drawing-in roller pair 22 rotating in the forward direction. As the drawing-in roller pair 22 rotates, the fold of the transfer sheet S is nipped therein and conveyed. When the overlapping portion (in double) of the transfer sheet S is conveyed to a predetermined position upstream from the drawing-in roller pair 22, the drawing-in roller pair 22 rotates in reverse.

Figure 5B:
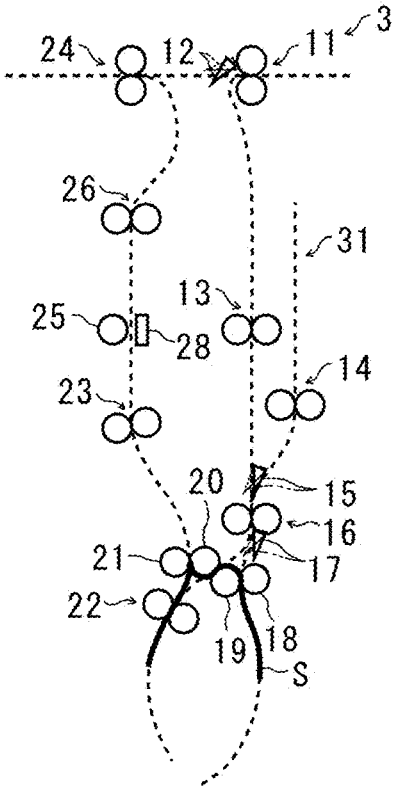

As the drawing-in roller pair 22 rotates in the reverse direction, the transfer sheet S is slackened between the pair of rollers 19 and 20 and the drawing-in roller pair 22. As illustrated in FIG. 5B, the slack of the transfer sheet S is guided between the third folding roller 20 and the fourth folding roller 21 and is nipped between the third folding roller 20 and the fourth folding roller 21.

Figure 5C:
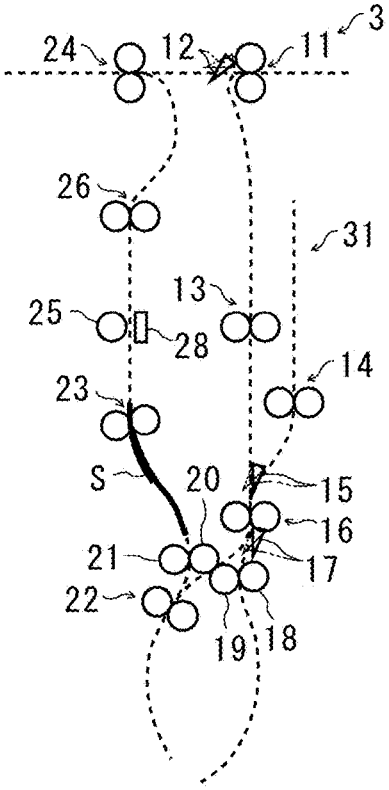
Figure 5D:
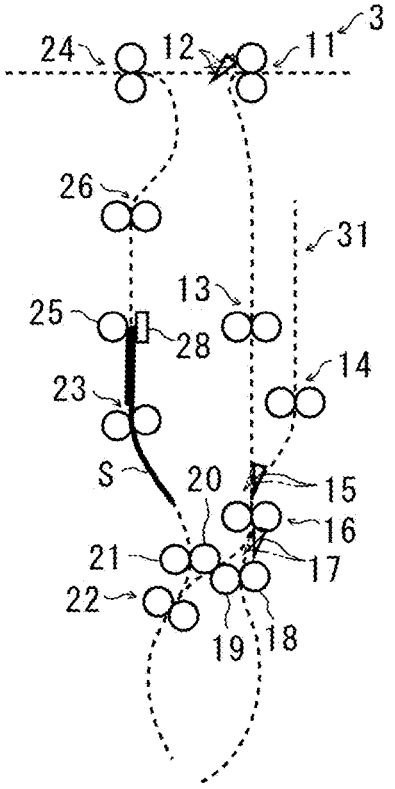

When the transfer sheet S is nipped by the third and fourth folding rollers 20 and 21, the fourth folding roller 21 starts rotating counterclockwise in FIG. 5B, and the second folding roller 19 stops rotating. The transfer sheet S nipped by the third and fourth folding rollers 20 and 21 is conveyed upward, and the second folding process is performed. The transfer sheet S on which the second folding process has been performed and the Z-folding process has been completed is sent to the conveyance roller pair 23 as illustrated in FIG. 5C. Then, as illustrated in FIG. 5D, the transfer sheet S is sent to the fold-enforcing roller 25 and subjected to a fold-enforcing process.

The transfer sheet S subjected to fold-enforcing is sent further upward by the conveyance roller pair 26 and is ejected from the sheet folding apparatus 3 by the ejection roller pair 24. With this series of operations, the Z-fold operation on the transfer sheet S by the sheet folding apparatus 3 completes. Here, the Z-folding operation has been described. However, in addition to the Z-folding, a variety of folding operations, such as half fold, letter fold-in, and letter fold-out, are possible.

As illustrated in FIG. 2, a sheet length sensor 32 as a sheet length detector to detect the leading end and the trailing end of the transfer sheet S is adjacent to the ejection roller pair 5. The sheet length sensor 32 turns on when detecting the leading end of the transfer sheet S, maintains the on state while the transfer sheet S is being conveyed, and turns off when the trailing end of the transfer sheet S passes by. The sheet length sensor 32 detects the length of the transfer sheet S based on the length of time of being on. The sheet length sensor 32 is a component of the sheet folding apparatus 3 and is attached to the body of the image forming apparatus 2 when the sheet folding apparatus 3 is connected to the image forming apparatus 2. The length information of the transfer sheet S detected by the sheet length sensor 32 is input to a controller 34, the description thereof is deferred. Note that, instead of the sheet length sensor 32, a sheet length sensor 33 configured similar to the sheet length sensor 32 and is disposed in the sheet folding apparatus 3 can be used. The sheet length sensor 33 is upstream from the entry roller pair 11 in the sheet conveyance direction.

The sheet folding apparatus 3 further includes an input device 35 (see FIG. 6, as a sheet length input device) on a control panel 60 (see FIG. 6) on the upper side of the sheet folding apparatus 3. Thus, when a transfer sheet roll is used as the transfer sheet, the user can input the length of the sheet via the input device 35. The length is the same as the length input by the user on the control panel 9 of the image forming apparatus 2. The sheet folding apparatus 3 normally performs a folding operation based on the length of the transfer sheet input from the input device 35.

Figure 6:
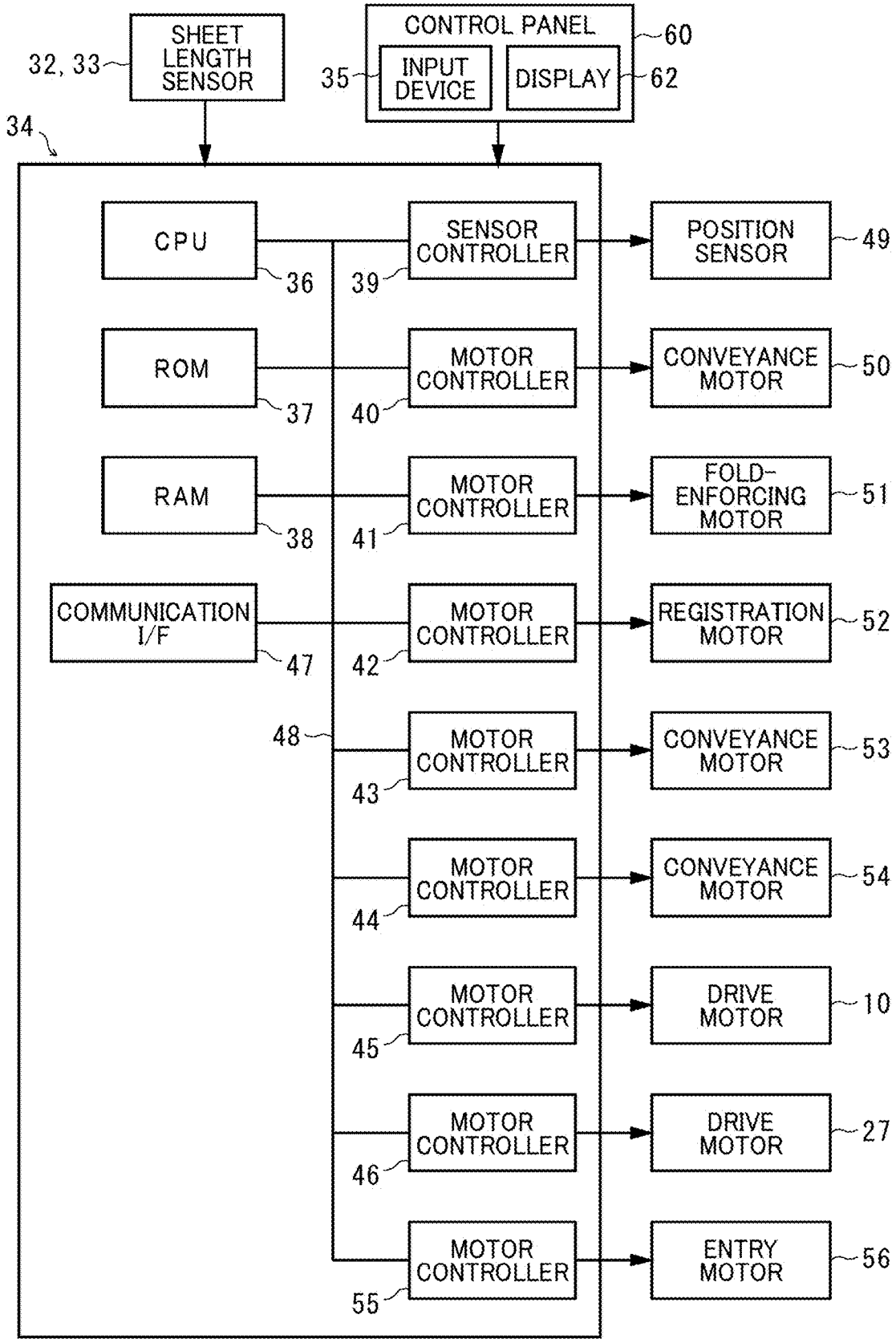
FIG. 6 is a block diagram illustrating a configuration of a controller according to one embodiment of the present disclosure.

FIG. 6 is a block diagram illustrating a configuration of the controller 34 that controls the operation of the sheet folding apparatus 3. The controller 34 illustrated in FIG. 6 includes a central processing unit (CPU) 36, a read only memory (ROM) 37, a random access memory (RAM) 38, a sensor controller 39, motor controllers 40, 41, 42, 43, 44, 45, 46, and 55, and a communication interface 47. These components are mutually and electrically connected via a bus line 48 such as an address bus or a data bus.

The CPU 36 executes a program stored in the ROM 37, thereby controlling the operation of the sheet folding apparatus 3. The ROM 37 stores data and programs executed by the CPU 36. The RAM 38 temporarily stores data and the like when the CPU 36 executes the programs.

The communication interface 47 communicates with the image forming apparatus 2 and the sheet post-processing apparatus 4, and exchanges data necessary for controlling the operation. The sensor controller 39 is connected to a position sensor 49 disposed on the fold-enforcing roller 25 and monitors the detection of the transfer sheet. The motor controller 40 controls a conveyance motor 50 that drives the conveyance roller pair 13. The motor controller 41 controls a fold-enforcing motor 51 that rotates the fold-enforcing roller 25. The motor controller 42 controls a registration motor 52 that drives the registration roller pair 16. The motor controller 43 controls a conveyance motor 53 that drives the conveyance roller pair 23.

The motor controller 44 controls a conveyance motor 54 that drives the conveyance roller pair 26. The motor controller 45 controls the drive motor 10 that drives the second folding roller 19. The motor controller 46 controls the drive motor 27 that drives the fourth folding roller 21. The motor controller 55 controls an entry motor 56 that drives the entry roller pair 11.

As described above, the controller 34 controls forward and reverse rotations of the drive motors 10 and 27. The controller 34 also controls the speed of the drive motors 10 and 27, which can be changed at least in two stages, i.e., the low speed as the first speed and the high speed as the second speed.

Here, the low speed of the drive motors 10 and 27 is such a speed that the conveyance speed of the transfer sheet is sufficiently lower than the speed of ejection of the transfer sheet by the ejection roller pair 5, and, when the sheet folding apparatus 3 folds the transfer sheet conveyed at the low speed (i.e., a first-speed folding operation), the folding position and the folding height comply with the setting of input by the user, to guarantee the quality.

On the other hand, the high speed is such a speed that the conveyance speed of the transfer sheet is substantially the same as or higher than the ejection speed of the transfer sheet by the ejection roller pair 5. The above-mentioned speed "substantially the same as or higher than" the ejection speed satisfies the following. In addition to when the speed is higher than the ejection speed, even when the speed is equal to or lower than the ejection speed, the speed does not cause a slack, which may result in jamming, between the ejection roller pair 5 and the entry roller pair 11 located immediately downstream from the ejection roller pair 5 until the conveyance of the transfer sheet completes.

The above-described control of at least two-stage including the low speed and the high speed by the controller 34 is performed in the entry motor 56, the conveyance motor 50, and the registration motor 52 in addition to the drive motors 10 and 27. Each of the entry roller pair 11, the conveyance roller pair 13, and the registration roller pair 16 is controlled to operate at either low speed or high speed.

Figure 8:
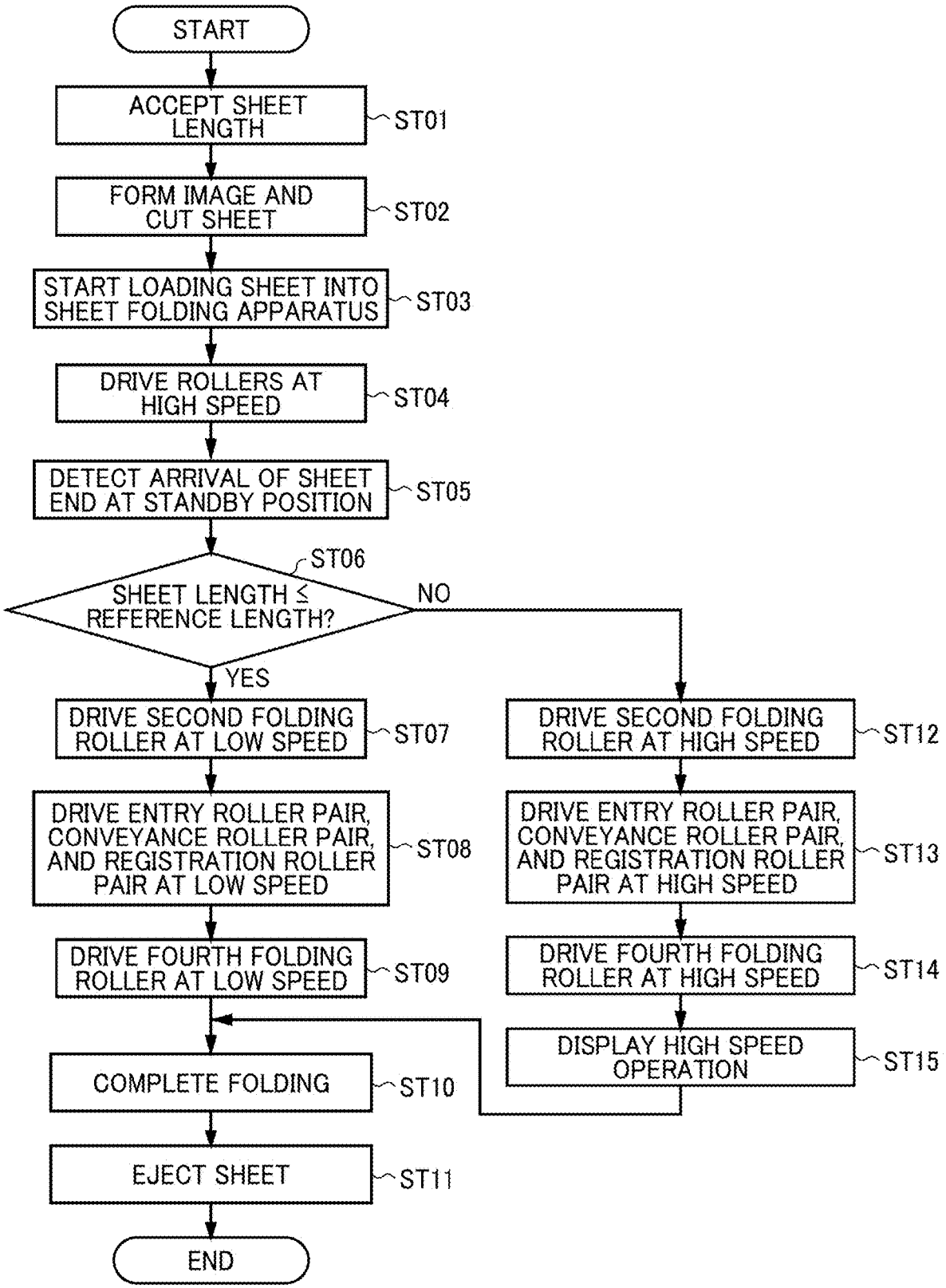
FIG. 8 is a flowchart illustrating a sheet folding process according to a first embodiment.

Based on the configuration described above, the operation of the image forming system 1 in the first embodiment is described below with reference to the flowchart illustrated in FIG. 8. In the following, a description is given of operation in a case where a roll of a long transfer sheet is set in the sheet feeder 7.

Figure 7:
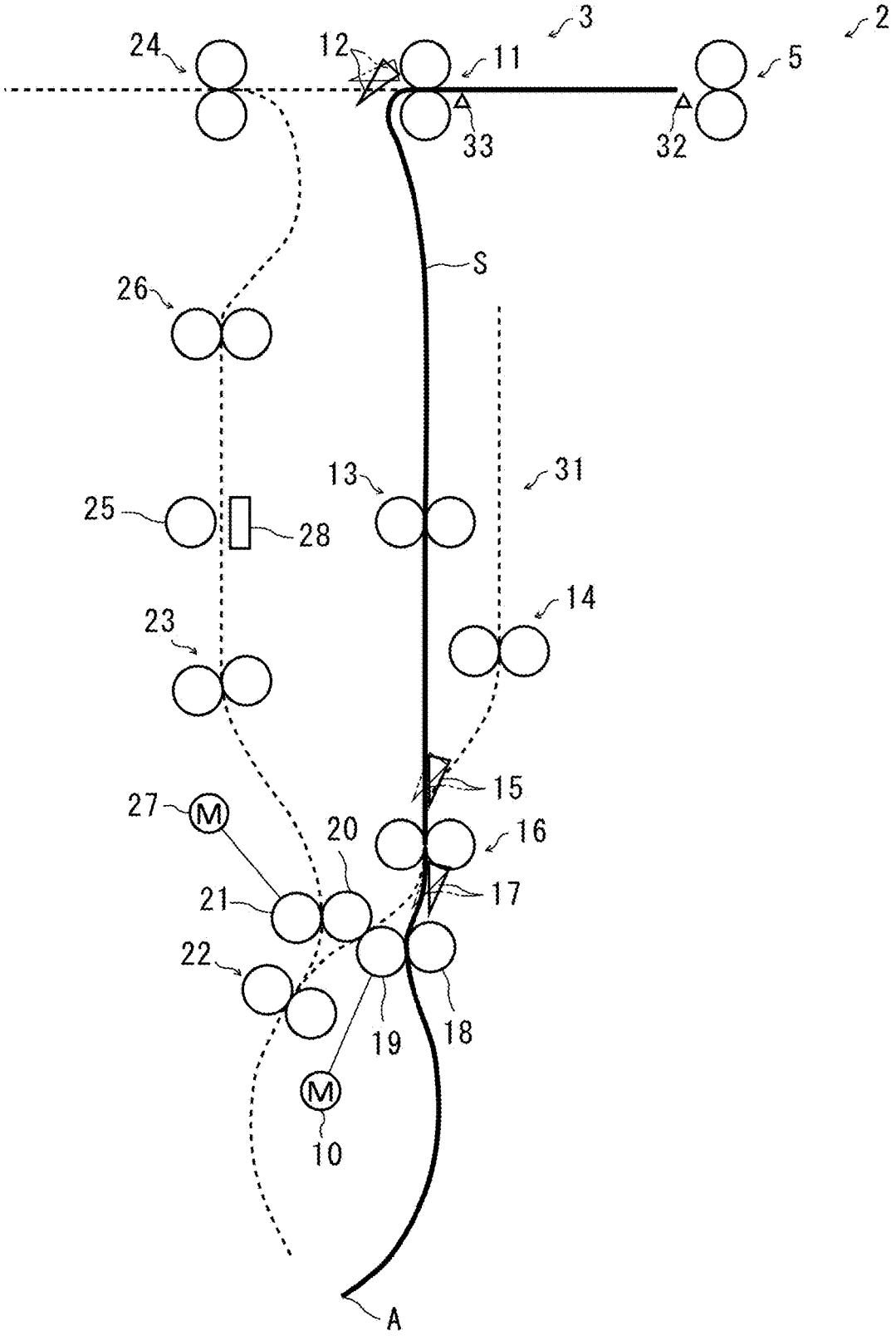
FIG. 7 is a schematic diagram illustrating a standby position and a reference length of a transfer sheet in the sheet folding apparatus illustrated in FIG. 2.

Prior to the description of the operation, a reference length of the transfer sheet S used for image formation is described. The transfer sheet S is unwound from the transfer sheet roll and cut by the cutter after image formation has been performed. Then, the transfer sheet S is fed to the sheet folding apparatus 3, and the leading end thereof is conveyed to a standby position A (a folding operation start position) in FIG. 7, at which the folding operation can be started. The length from the standby position A where the leading end of the transfer sheet S is located at that time to the position where the transfer sheet S is nipped by the ejection roller pair 5 is constant. The reference length is set to a length shorter by, for example, 10 mm, than such a constant length. That is, in the case of the transfer sheet S having the reference length, when the leading end thereof is at the standby position A, the trailing end thereof exits the nip of the ejection roller pair 5. That is, the reference length is from an exit position at which the transfer sheet S exits the ejection roller pair 5 to the standby position A downstream from the nip between the first and second folding rollers 18 and 19.

Prior to image formation, the user sets, on the control panel 9 of the image forming apparatus 2, the length of the transfer sheet to a desired length and inputs the desired length to the input device 35 of the sheet folding apparatus 3, and the controller 34 accepts the sheet length (ST01). Thereafter, when a start key on the control panel 9 of the image forming apparatus 2 is turned on, the transfer sheet is fed from the transfer sheet roll, and the image formation is performed thereon in the image forming apparatus 2. After the image formation completes, the cutter cuts the portion of the sheet fed from the roll, which becomes a transfer sheet S having the desired length (ST02). The ejection roller pair 5 ejects the transfer sheet S from the image forming apparatus 2, and the entry roller pair 11 starts loading the transfer sheet S into the sheet folding apparatus 3 (ST03).

Specifically, in response to the detection of the leading end of the transfer sheet S by the sheet length sensor 32 or the sheet length sensor 33, the entry roller pair 11, the conveyance roller pair 13, the registration roller pair 16, and the second folding roller 19 are driven. Thus, the loading of the transfer sheet S into the sheet folding apparatus 3 is started (ST03). At this time, since the ejection of the transfer sheet S by the ejection roller pair 5 continues, the controller 34 drives the entry motor 56, the conveyance motor 50, the registration motor 52, and the drive motor 10 at the high speed to rotate the entry roller pair 11, the conveyance roller pair 13, the registration roller pair 16, and the second folding roller 19 at the high speed (ST04). When a sensor detects the arrival of the leading end of the transfer sheet S at the standby position A, the sheet folding apparatus 3 temporarily stops (ST05).

Thereafter, the controller 34 determines whether or not the sheet length input to the input device 35 is equal to or smaller than the above-described reference length (ST06). In response to a determination that the input sheet length is equal to or smaller than the reference length, the controller 34 drives the drive motor 10 at the low speed to rotate the second folding roller 19 at the low speed, and the above-described folding is performed at the low speed, which is the first-speed folding operation, (ST07). The controller 34 further drives the entry motor 56, the conveyance motor 50, and the registration motor 52 at the low speed, to rotate the entry roller pair 11, the conveyance roller pair 13, and the registration roller pair 16 at the low speed (ST08). Thereafter, the controller 34 drives the drive motor 27 at the low speed, to rotate the fourth folding roller 21 at the low speed, and the folding operation is continued (ST09). When the folding operation completes (ST10), the sheet folding apparatus 3 forwards the transfer sheet S to the sheet post-processing apparatus 4. After performing post-processing thereon, the sheet post-processing apparatus 4 ejects the transfer sheet S (ST11). Thus, a series of operations completes.

Note that the destination to which the transfer sheet S is ejected from the sheet post-processing apparatus 4 is selectable from an output tray on the upper side of the apparatus body of the sheet post-processing apparatus 4 in FIG. 1 and an output tray on the left of the apparatus body in FIG. 1. Further, without providing the sheet post-processing apparatus 4, the transfer sheet S may be ejected into the sheet folding apparatus 3. However, in the case of a compact apparatus, there is a possibility that the width of the apparatus is smaller than the length of the long sheet after the folding process. Accordingly, connecting the sheet post-processing apparatus 4 on the downstream side of the sheet folding apparatus 3 and ejecting the sheet thereto can facilitate removal of the transfer sheet S from the apparatus.

In response to a determination in ST06 that the input sheet length is longer than the reference length, the controller 34 drives the drive motor 10 at the high speed, to rotate the second folding roller 19 at the high speed. Then, the folding operation at the high speed (a second-speed folding operation) starts (ST12). The controller 34 further drives the entry motor 56, the conveyance motor 50, and the registration motor 52 at the high speed, to rotate the entry roller pair 11, the conveyance roller pair 13, and the registration roller pair 16 at the high speed (ST13). Thereafter, the controller 34 drives the drive motor 27 at the high speed, to rotate the fourth folding roller 21 at the high speed, and the folding operation is continued (ST14). At this time, there is a risk that the folding conditions (such as the folding position and the folding height) of the transfer sheet S may deviate from the settings since the folding is performed at high speed. The controller 34 causes a notification device, such as a display 62, to notify the user of such a risk (ST15). The display 62 is included, similar to the input device 35, in the control panel 60 on the upper side of the sheet folding apparatus 3 in FIG. 1. Thereafter, the process proceeds to ST10 to complete a series of operations.

According to the above-described first embodiment, when the length, in the sheet conveyance direction, of the transfer sheet S to be folded is equal to or smaller than the reference length, it is not necessary to consider the risk of jamming of the transfer sheet S in the sheet folding apparatus 3. Therefore, the entry roller pair 11, the registration roller pair 16, the second folding roller 19, and the first folding roller 18 that rotates with the second folding roller 19 are rotated at the low speed that guarantees the quality of the folding. Accordingly, the sheet folding apparatus 3 can provide a high-quality folded product. When the length of the transfer sheet S, which is to be folded, in the sheet conveyance direction is longer than the reference length, the transfer sheet S may be jammed in the sheet folding apparatus 3. Therefore, the entry roller pair 11, the registration roller pair 16, the second folding roller 19, and the first folding roller 18 rotated by the second folding roller 19 are rotated at the high speed which is substantially the same as or higher than the ejection speed of the transfer sheet S by the ejection roller pair 5. Therefore, jamming of the transfer sheet S in the sheet folding apparatus 3 can be reliably prevented.

The sheet folding apparatus 3 further includes the notification device to indicate the high-speed folding operation when the folding operation is performed at the high speed. Therefore, the sheet folding apparatus 3 can notify the user of the risk that the quality of the output folded product is not secured. Further, in the first embodiment, the sheet folding apparatus 3 determines the length of the transfer sheet S in the sheet conveyance direction based on the input from the input device 35. Therefore, the sheet length sensors 32 and 33 can be omitted, to simplify the configuration.

A second embodiment of the present disclosure is described below. In the above-described first embodiment, the sheet folding apparatus 3 determines the length, in the sheet conveyance direction, of the transfer sheet S to be folded based on the input from the input device 35. Differently from that, in the second embodiment, the sheet folding apparatus 3 determines the length of the transfer sheet S in the sheet conveyance direction based on a signal from the sheet length sensor 32 or the sheet length sensor 33. Other configurations are the same as those of the first embodiment.

As described above, the sheet length sensor 32 turns on in response to the detection of the leading end of the transfer sheet S, maintains the on state while the transfer sheet S is being conveyed, and turns off when the trailing end of the transfer sheet S passes by. The sheet length sensor 32 detects the length of the transfer sheet S based on the length of time of being on. The controller 34 recognizes the detected length of the transfer sheet S, and the length is used as the sheet length in ST06 of the flowchart illustrated in FIG. 8.

According to the second embodiment, the length of the transfer sheet S in the sheet conveyance direction is automatically detected by the sheet length sensor 32 or the sheet length sensor 33. There is no need for the user to input the length of the transfer sheet S, and the operability can improve. Further, when the length of the transfer sheet S is longer than the reference length, the signal from the sheet length sensor 32 or the sheet length sensor 33 is not turned off. Accordingly, the controller 34 can reliably determine that the length is equal to or longer than the reference length.

Although requiring attaching of the sheet length sensor 32 to the apparatus body of the image forming apparatus 2, use of the sheet length sensor 32 is advantageous. Since the signal from the sensor stops immediately after the trailing end of the transfer sheet S exits the ejection roller pair 5, the transfer sheet S having a length similar to the reference length can be folded at low speed. When the sheet length sensor 33 is used, the signal of the sensor is discontinued shortly after the trailing end of the transfer sheet S comes out of the ejection roller pair 5. Thus, the transfer sheets S foldable at low speed are limited to those shorter than the reference length. However, this configuration is advantageous in that attaching and detaching the sensor are not necessary, improving the operability, since the sheet folding apparatus 3 includes the sensor.

Figure 9:
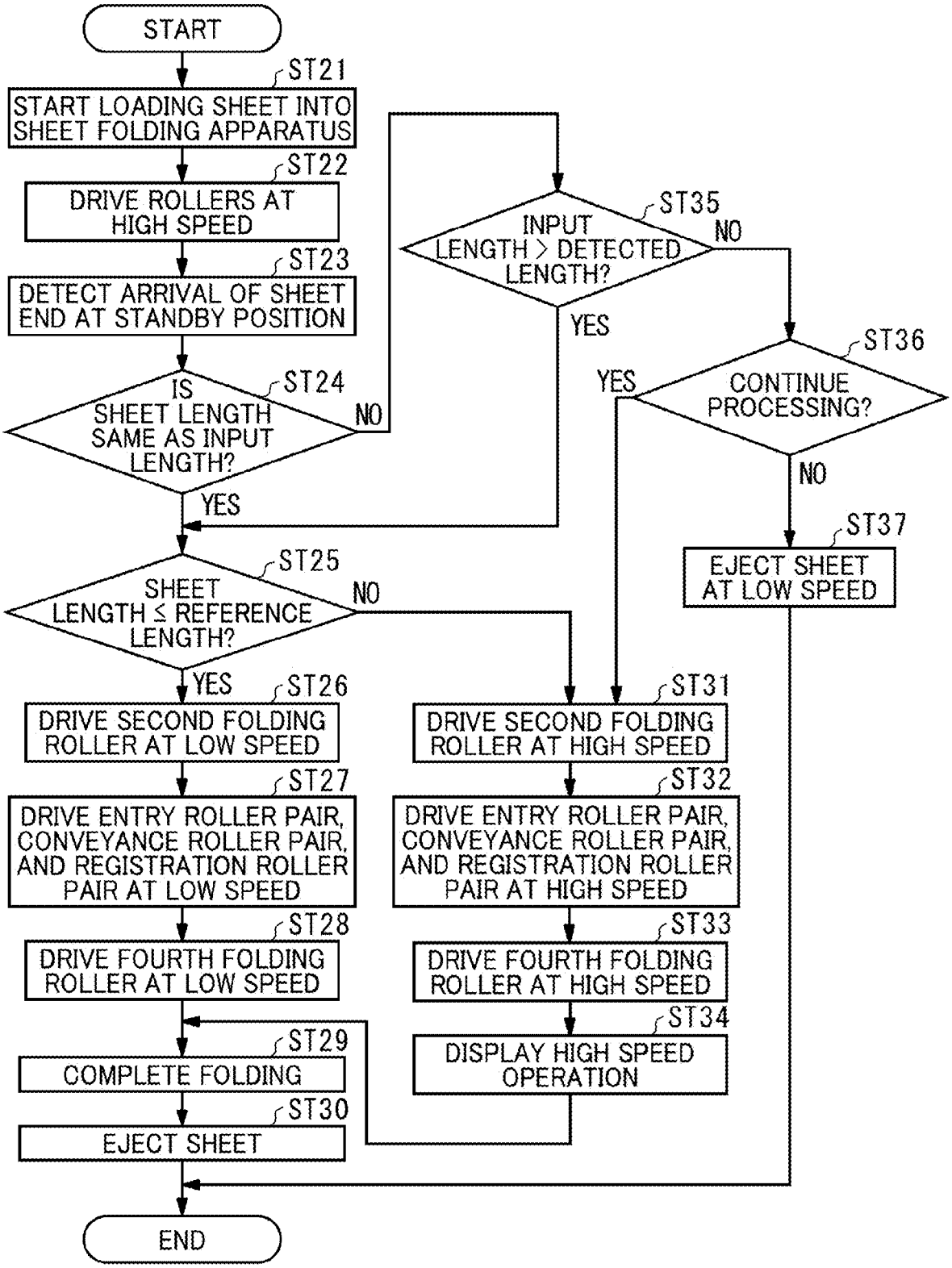
FIG. 9 is a flowchart illustrating a sheet folding process according to a third embodiment.

A third embodiment of the present disclosure is described below. In the third embodiment, the sheet folding apparatus 3 determines the length of the transfer sheet S in the sheet conveyance direction based on both the length input from the input device 35 and the length detected by the sheet length sensor 32 or the sheet length sensor 33. Other configurations are the same as those of the first embodiment. Hereinafter, the operation in the third embodiment is described referring to the flowchart illustrated in FIG. 9. Prior to image formation, the user sets the length of the transfer sheet to a desired length on the control panel 9, and inputs the desired length to the input device 35 of the sheet folding apparatus 3.

When a start key on the control panel 9 of the image forming apparatus 2 is turned on, the transfer sheet is fed from the transfer sheet roll, and the image formation is performed thereon in the image forming apparatus 2. After the image formation completes, the cutter cuts the portion of the sheet fed from the roll, which becomes a transfer sheet S having the desired length. The ejection roller pair 5 ejects the transfer sheet S from the image forming apparatus 2, and loading of the transfer sheet S into the sheet folding apparatus 3 is started.

In response to the detection of the leading end of the transfer sheet S by the sheet length sensor 32 or the sheet length sensor 33, the entry roller pair 11, the conveyance roller pair 13, the registration roller pair 16, and the second folding roller 19 are driven. Thus, the loading of the transfer sheet S into the sheet folding apparatus 3 is started (ST21). At this time, since the ejection of the transfer sheet S by the ejection roller pair 5 continues, the controller 34 drives the entry motor 56, the conveyance motor 50, the registration motor 52, and the drive motor 10 at the high speed to rotate the entry roller pair 11, the conveyance roller pair 13, the registration roller pair 16, and the second folding roller 19 at the high speed (ST22). When the sensor detects the arrival of the leading end of the transfer sheet S at the standby position A, the sheet folding apparatus 3 temporarily stops (ST23).

At this time, the sheet length sensor 32 or 33 detects the length of the transfer sheet S conveyed in the sheet conveyance direction. The controller 34 accepts the detected length of the transfer sheet S.

The controller 34 accepting the detected length by the sheet length sensor 32 or 33 determines whether or not the length input to the input device 35 is the same as the detected length (ST24). In response to a determination that the length is the same, the controller 34 determines whether the sheet length is equal to or smaller than the above-described reference length (ST25). In response to a determination that the length is equal to or smaller than the reference length, the controller 34 drives the drive motor 10 at the low speed, to rotate the second folding roller 19 at the low speed, and the above-described folding operation is started (ST26). The controller 34 further drives the entry motor 56, the conveyance motor 50, and the registration motor 52 at the low speed, to rotate the entry roller pair 11, the conveyance roller pair 13, and the registration roller pair 16 at the low speed (ST27). Thereafter, the controller 34 drives the drive motor 27 at the low speed, to rotate the fourth folding roller 21 at the low speed, and the folding operation is continued (ST28). When the folding operation completes (ST29), the sheet folding apparatus 3 forwards the transfer sheet S to the sheet post-processing apparatus 4. After performing post-processing thereon, the sheet post-processing apparatus 4 ejects the transfer sheet S (ST30). Thus, a series of operations completes.

In response to a determination in ST25 that the sheet length is longer than the reference length, the controller 34 drives the drive motor 10 at the high speed, to rotate the second folding roller 19 at the high speed. Then, the folding operation starts (ST31). The controller 34 further drives the entry motor 56, the conveyance motor 50, and the registration motor 52 at the high speed, to rotate the entry roller pair 11, the conveyance roller pair 13, and the registration roller pair 16 at the high speed (ST32). Thereafter, the controller 34 drives the drive motor 27 at the high speed, to rotate the fourth folding roller 21 at the high speed, and the folding operation is continued (ST33). At this time, there is a risk that the folding position, the folding height, and the like of the transfer sheet S may deviate from the settings since the folding operation is performed at the high speed. The controller 34 causes the notification device, such as the display 62, to display the risk (ST34). The display 62 is included, similar to the input device 35, in the control panel 60 on the upper side of the sheet folding apparatus 3 in FIG. 1. Thereafter, the process proceeds to ST29 to complete a series of operations.

In response to a determination in ST24 that the detected length is different from the input length, the controller 34 determines whether or not the input length is longer than the detected length (ST35). When the input length is longer than the detected length, the sheet length sensor 32 or 33 detects the trailing end of the transfer sheet S even though the data indicates that the ejection roller pair 5 keeps ejecting the transfer sheet S. Therefore, the length of the transfer sheet S in the sheet conveyance direction can be measured, and the process proceeds to ST25 to determine whether the length of the transfer sheet S is equal to or smaller than the reference length.

In ST35, when the input length is shorter than the detected length, the sheet length sensor 32 or 33 has not yet detect the trailing end of the transfer sheet S even though the data indicates that the ejection roller pair 5 has completed ejection of the transfer sheet S. Therefore, the length of the transfer sheet S in the transport direction is unknown. In this case, the user selects whether or not to perform the subsequent folding operation.

Specifically, controlled by the controller 34, the control panel 60 (the display 62) on the upper side of the sheet folding apparatus 3 FIG. 1 displays a message, such as "Do you want to continue folding operation?" Thus, the controller 34 prompts the user to determine whether or not to perform the subsequent folding operation (ST36). Since the cases of continuing the operation includes the case where the length of the transfer sheet S in the sheet conveyance direction is equal to or longer than the reference length, the process proceeds to ST31 to perform the high-speed folding operation. In response to input of discontinuing the folding operation, the sheet folding apparatus 3 conveys the transfer sheet S at the low speed without performing the folding operation, and the ejection roller pair 5 continues the conveyance of the transfer sheet S at the sheet ejection speed (ST37). Therefore, in some cases, it is necessary to resolve the jamming of the transfer sheet S in the sheet folding apparatus 3.

In the above-described third embodiment, even when the user inputs a wrong length of the transfer sheet S, the folding operation can be continued when the user does not expect high quality. In addition, the folding operation can be stopped. In this case, resolving the jamming in the sheet folding apparatus 3 may be performed. However, output of a folded product of low quality can be prevented. Thus, inconveniences due to the output of substandard products can be prevented.

In the above-described embodiments and modifications, the image forming apparatus 2, which is a full-color copier, is described as an example of an image forming apparatus, but the image forming apparatus is not limited thereto. The present disclosure is adoptable to a printer, a facsimile machine, a multifunction peripheral (MFP), and monochrome machines. In the above-described embodiments, an image is formed on the transfer sheet S as a recording medium. The transfer sheet S can be thick paper, a postcard, an envelope, plain paper, thin paper, coated paper (e.g., art paper), tracing paper, an overhead projector (OHP) transparency sheet (or OHP film), a resin film, and any other sheet material to bear an image and can be folded.

The above-described embodiments are illustrative and do not limit the present disclosure. Thus, numerous additional modifications and variations are possible in light of the above teachings. For example, elements and/or features of different illustrative embodiments may be combined with each other and/or substituted for each other within the scope of the present disclosure.

The advantages achieved by the embodiments described above are examples and therefore are not limited to those described above.

Any one of the above-described operations may be performed in various other ways, for example, in an order different from the one described above.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA) and conventional circuit components arranged to perform the recited functions.

What is claimed is:

1. A sheet folding apparatus configured to fold a sheet ejected from an upstream apparatus to which the sheet folding apparatus is coupled, the sheet folding apparatus comprising:

a conveyance member configured to receive the sheet ejected from an ejection member of the upstream apparatus and convey the sheet in a sheet conveyance direction at either a first speed lower than a conveyance speed of the sheet by the ejection member or a second speed substantially same as or higher than the conveyance speed by the ejection member;

a registration member configured to nip the sheet from the conveyance member and convey, at a timing, the sheet downstream in the sheet conveyance direction at either the first speed or the second speed;

a pair of a first roller and a second roller configured to nip and convey the sheet from the registration member at either the first speed or the second speed, the pair of the first roller and the second roller configured to rotate in forward and reverse directions;

a plurality of folding rollers disposed downstream from the second roller in the sheet conveyance direction and configured to rotate in forward and reverse directions to fold the sheet; and control circuitry configured to determine whether a length of the sheet in the sheet conveyance direction is equal to or smaller than a reference length, the reference length from an exit position from the ejection member to a folding operation start position downstream from the pair of the first roller and the second roller in the sheet conveyance direction;

perform first-speed folding in which the conveyance member, the registration member, and the pair of the first roller and the second roller rotate at the first speed to fold the sheet, in response to a determination that the length of the sheet is equal to or smaller than the reference length; and perform second-speed folding in which the conveyance member, the registration member, and the pair of the first roller and the second roller rotate at the second speed to fold the sheet, in response to a determination that the length of the sheet is longer than the reference length.

2. The sheet folding apparatus according to claim 1, further comprising a notification device, wherein the control circuitry is configured to cause the notification device to indicate that folding is performed at the second speed when the second-speed folding is performed.

3. The sheet folding apparatus according to claim 2, further comprising:

a sheet length detector configured to detect the length of the sheet in the sheet conveyance direction; and a sheet length input device configured to input the length of the sheet in the sheet conveyance direction, wherein the notification device is a display, and wherein the control circuitry is configured to:

compare the length of the sheet detected by the sheet length detector and the length of the sheet input from the sheet length input device; and cause the display to display a message whether to perform folding based on the length of the sheet detected by the sheet length detector, in response to a determination that the detected length is different from the input length.

4. The sheet folding apparatus according to claim 3, wherein the control circuitry is configured to:

cause the display to display a message whether to perform the second-speed folding or convey the sheet without folding the sheet, in response to a determination that the length input from the sheet length input device is shorter than the length detected by the sheet length detector; and cause the display to indicate that folding is performed at the second speed when the second-speed folding is performed.

5. The sheet folding apparatus according to claim 1, further comprising a sheet length detector configured to detect the length of the sheet in the sheet conveyance direction, wherein the control circuitry is configured to determine the length of the sheet in the sheet conveyance direction based on a detection result from the sheet length detector.

6. The sheet folding apparatus according to claim 5, wherein the sheet length detector is at an upstream end in the sheet conveyance direction in the sheet folding apparatus and to be adjacent to the ejection member when the sheet folding apparatus is connected to the upstream apparatus.

7. The sheet folding apparatus according to claim 5, wherein the sheet length detector is adjacent to the conveyance member.

8. The sheet folding apparatus according to claim 1, further comprising a sheet length input device configured to input the length of the sheet in the sheet conveyance direction, wherein the control circuitry is configured to determine the length of the sheet in the sheet conveyance direction based on the length of the sheet input from the sheet length input device.

9. An image forming system comprising:

the sheet folding apparatus according to claim 1; and the upstream apparatus including the ejection member, wherein the upstream apparatus is an image forming apparatus configured to form an image on the sheet.

* * * * *